10/27/87 XR 4,703,405

United States Patent [19]

Lewin

[11] Patent Number: 4,703,405

[45] Date of Patent: Oct. 27, 1987

[54] GLARE REDUCING LENS

[76] Inventor: Ian Lewin, 11408 St. Andrew's Way, Scottsdale, Ariz. 85254

[21] Appl. No.: 886,650

[22] Filed: Jul. 17, 1986

[51] Int. Cl.[4] ..... F21V 9/00

[52] U.S. Cl. ..... 362/333; 362/330; 362/334; 350/167; 350/276 R

[58] Field of Search ..... 362/333, 326, 330, 334; 350/267, 276 R

[56] References Cited

U.S. PATENT DOCUMENTS

| | | | |
|---|---|---|---|
| 2,434,049 | 1/1948 | Nordquist | 240/51.11 |
| 2,859,334 | 11/1958 | Guth | 362/330 |
| 3,716,709 | 2/1973 | Goytisolo Taltavull | 362/330 |
| 3,735,124 | 5/1973 | Stahlhut | 362/333 |
| 3,763,369 | 10/1973 | Lewin | 240/106 |
| 3,794,829 | 2/1974 | Taltavull | 362/330 |

OTHER PUBLICATIONS

IES Transaction Journal (Apr. 1973) (pp. 209-214).

*Primary Examiner*—Larry Jones
*Attorney, Agent, or Firm*—LaValle D. Ptak

[57] ABSTRACT

A refractive lens member for use with a luminaire is constructed to minimize high angle glare. The grid comprises a plurality of lenses which are interconnected by a rib structure to form a pattern of lenses in a network grid, with the lenses all lying substantially in the same plane. Each individual lens has a flat circular light incident surface and each lens has a substantially convex, spherical section light emergent surface. The rib structure is made of the same material as the lenses and may be integrally formed with the lenses to form the network grid. The rib structure is constructed to cooperate with the lenses to which prevent light at angles outside a pre-established range arrives on the light incident side surfaces from exiting from the light emergent surfaces of said lenses.

15 Claims, 11 Drawing Figures

GLARE REDUCING LENS

BACKGROUND

Ceiling luminaries are widely used in commercial installations to provide both overall lighting and concentrated area lighting to the rooms in which they are placed. For many years, little effort was made to reduce high angle glare from such fixtures or to spread the light or shape the light pattern emitted from the lamps in such fixtures. In addition, the lamps themselves frequently were directly visible.

In recent years, however, it has become increasingly important to engineer such ceiling light fixtures in a manner to more evenly distribute the light emanating from the fixtures and to eliminate, as much as possible, the high angle light which causes uncomfortable glare to persons located within the room in which such fixtures are located. Attempts also have been made to develop lenses which hide the lamp, that is which spread the light emanating from the luminaire in a manner as to obscure the shape of the lamp located within the luminaire when the luminaire is viewed from below.

Simple diffusers are widely used to hide the lamps, and diffusers generally perform this function satisfactorily. Such diffusers, however, tend to be low in efficiency and accomplish little or nothing in glare control (that is elimination of high angle light rays). Prismatic lenses of a variety of different designs have been developed to provide reasonably good lamp hiding power with high efficiency, but such prismatic lenses produce glare due to undesirably high brightness close to the horizontal.

Attempts have been made at designing luminaires which employ refractive lenses designed to eliminate glare (high angle light). Such lenses are disclosed in the U.S. Pat. Nos. 2,434,049 and 3,763,369 to Nordquist and Lewin. The lens of the Nordquist patent has a number of interconnected elongated lens sections extending transversely across the width of a fluorescent light fixture. Each of the lens sections is formed with a convex light emergent portion, and the lens sections are provided with upwardly tapering ribs of opaque or reflective material designed to block light above certain angles longitudinally of the fixtures. The result of the Nordquist lens is to minimize endwise glare from the fixture. Transverse glare, however, is relatively unaffected.

A refractive grid designed to minimize glare in all directions is disclosed in the Lewin Pat. No. 3,763,369. The glare reduction capabilities of the lens of this patent and the manner of measuring glare and luminaire efficiency are discussed in detail in an article appearing in the *Journal of IES*, April 1973, on Pages 209 through 214 entitled "NEW CONCEPTS IN DIRECT GLARE CONTROL", by Ian Lewin. The refractive grid of Lewin's U.S. Pat. No, 3,763,369 provides fairly good glare control although some high angle light rays are emitted from the refractive grid of the U.S. Pat. No. 3,763,369.

The grid or lens of Lewin's U.S. Pat. No. 3,763,369 consists of a large number of concavo-convex circular lenses interconnected in a honeycomb-like pattern to form the refractive grid. The top surface of each of these interconnected lenses is a concave light incident surface, and the convex side of each of the lenses comprises the light emergent surface. The radii of the two surfaces are slightly different, with a slightly smaller radius being employed for the convex light emergent surface than for the concave light incident surface. The individual lenses are joined together with a relatively high angle screening surface to block high angle light from passing through the lens grid.

While the lens of U.S. Pat. No. 3,763,369 substantially reduces glare, it does not provide very good lamp hiding power. Light rays passing through the concave light incident surface on the top of the lens and emerging from the convex bottom surface of the lens undergo nearly self-cancelling refraction at the two surfaces, so that a viewer sees the relatively undisturbed rays just as if he were looking through a window. Consequently, the lamp is clearly defined and visible to a viewer standing below the lens and looking up into it. To improve the light hiding capabilities of luminaries using a lens of the type disclosed in the U.S. Pat. No. 3,763,369 a diffuser is placed over the lens or an auxiliary refractor sometimes is placed between the lamp and the lens to achieve a more even brightness. This is done, however, at substantial cost and with reduced efficiency from the luminaire.

It is desirable to provide a lens for a luminaire which significantly reduces undesirable glare, provides high efficiency and obscures (hides) the lamp contained in the luminaire to provide an appearance of even brightness.

SUMMARY OF THE INVENTION

Accordingly it is an object of this invention to provide an improved lens for a luminaire.

It is another object of this invention to provide a lens for a luminaire which reduces undesirable glare.

It is an additional object of this invention to provide a lens for a luminaire which has good lamp hiding capability.

It is a further object of this invention to provide a lens for a luminaire which has good lamp hiding capability and which minimized undesirable glare.

It is yet another object of this invention to provide a lens for a luminaire which obscures the lamps within the luminaire by redistributing the light to remove hot spots and even the light across the entire lens surface.

It is yet another object of this invention to provide a lens comprising a grid of interconnected individual plano-convex circular lens elements each having an identical cross-section in any vertical plane through the lens elements.

In accordance with the preferred embodiment of this invention, a refractive lens member for use with luminaire having a light source includes a plurality of individual lenses, each having a substantially flat circular light incident surface and each having a substantially convex spherical section light emergent surface. Ribs interconnect the lenses into a network grid, and the ribs prevent incident light from exiting through the emergent surfaces of the lenses at angles greater than a predetermined angle from lines perpendicular to the flat incident surfaces of the lenses.

DETAILED DESCRIPTIONS

Figure 1:
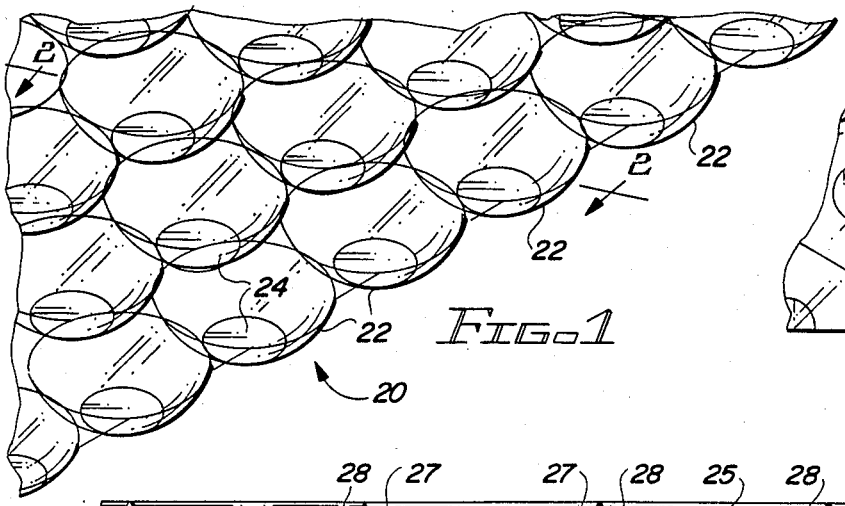
FIG. 1. is a bottom perspective view of a portion of a lens network grid in accordance with a preferred embodiment of the invention.

Reference now should be made to the drawings in which the same reference numbers are used throughout the different figures to designate the same or similar components. In FIGS. 1 through 4, the details of a preferred embodiment of the invention are illustrated. This embodiment comprises a network grid 20 consisting of off-set rows of individual transparent lens prisms of a plano-convex configuration with a convex light emergent surface 22 and a planar light incident surface 25. The lowermost point of each of the convex light emergent surfaces also comprises a flat circular portion 24 in a plane parallel to the light incident surface 25. The diameter of the portion 24 is approximately $\frac{1}{4}$ to $\frac{1}{3}$ of the diameter of the upper or light incident surface 25 of each of the individual lens elements. The lens elements of the net grid 20 are all circular in plan view, as is most apparent from a reference to FIGS. 3 and 4 which show the bottom plan view and top plan view, respectively, one of the grid of FIG. 1. Cross-sections through each of the individual lenses forming a part of the network are identical in any vertical plane to the surfaces 25. The individual lenses of the network 20 are of relatively small diameter with respect to the overall size of the fixture with which they are used. Fixture typically are one to two feet wide and two to four feet long. A typical diameter of each individual lens is $\frac{3}{8}''$, with the diameter of the portion 25 being 0.290 inches. In addition the radius of the convex bottom surface is small (typically 0.2365 inches) so that strong refraction of light rays passing through each individual lens occurs.

The strong refraction produced by each of the small lens elements comprising the network grid 20 results in excellent lamp hiding results. Each of the lenses or lens prisms produces a miniature image of the lamp; so that the strips of light and dark areas which are common with other lenses, including the lens of U.S. Pat. No. 3,763,369, are removed. Because the individual lamp images are very small, the eye of a viewer in the room integrates the overall effect over the network grid of lenses. Ideally, each of the individual circular lenses are less than $\frac{1}{2}''$ in diameter as measured from the widest point where the surface 22 of one lens abuts against the surface 22 of an adjoining lens.

Figure 3:
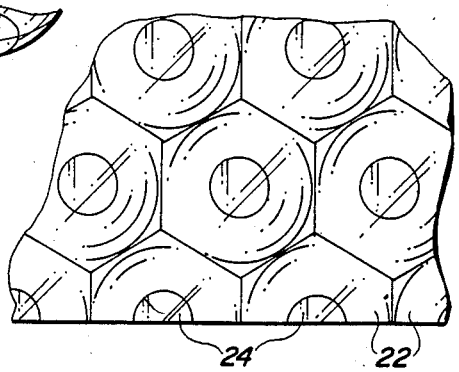
FIG. 3 is a bottom view of the grid of FIG. 1.
Figure 4:
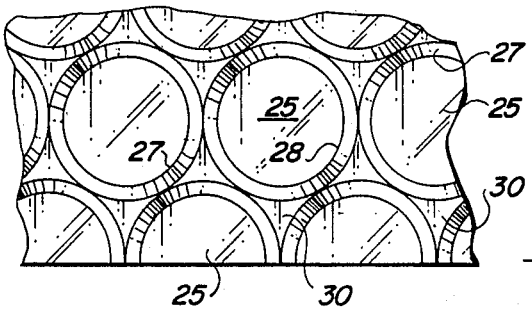
FIG. 4 is a top view of the grid of FIG. 1.

As it most apparent from an examination of FIGS. 3 and 4, the individual lenses in adjoining rows are off-set from one another; so that lines drawn through the centers of the lenses in alternate rows intersect the tangents of adjoining lenses in the intervening rows. The result is that the lenses are in a generally honeycomb pattern, with each individual lens surrounded by six other lenses in a hexagonal configuration. This is shown most clearly in FIG. 3.

By employing light incident and light emergent surfaces which are significantly non-parallel, increased refraction of light rays impinging upon the upper or light incident surface of the lens network occurs; and the radius of curvature of the light emergent surface 22 is selected to provide strong concentration of light emerging from the network grid in the useful region or zone beneath the grid extending from 0° (a line perpendicular to the plane of the surface 25) to 60°. Unpleasant or irritating glare is primarily present in the zone from 60° to 90°, as described in detail in the above mentioned IES Transaction article.

The region of the most uncomfortable glare is primarily concentrated in the range from 70° to 90°; and to concentrate light in the useful area from 0° to 60°, an additional transparent prism network is used to interconnect each of the lens elements. This prism network comprises frusto-conical sections 27 and 28 which flare upwardly and outwardly at an angle of approximately 125° from the surfaces 25 of each of the individual lens elements. The frusto-conical sections 27 and 28 are identical and alternate within individual lenses in each row of lenses illustrated in FIGS. 1 through 4. The two reference numbers 27 and 28 are used to distinguish between the surface extending upwardly from adjacent lenses. Where the individual lenses touch or are tangent to one another, the two surfaces 27 and 28 also touch. This produces a triangular cross-sectional configuration as is shown most clearly in FIG. 2. Where the lenses are not touching, however, the plane of the interconnecting network produces flat triangular shaped portions 30, generally in the form of equalateral triangles with curved sides (the radius of curvature of which is that of the individual lenses). This is shown most clearly in FIG. 4. The thickness of the grid from the plane of the portions 30 to the plane of the surface 24 typically is 0.181 inches.

Figure 5:
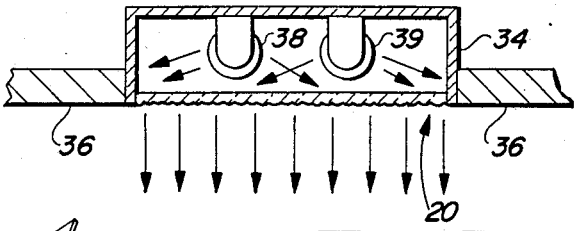
FIG. 5 is a cross-sectional view of a typical light fixture in which the grid of FIG. 1 is used.

FIG. 5 illustrates a typical luminaire with which a refractive lens network grid 20 of the type shown in FIGS. 1 through 4 is used. The lens network is placed on the light emergent side of a troffer 34 recessed into a ceiling 36. Typically, two or more elongated flourescent lights 38 and 39 are placed within the troffer 34. The lens network grid 20 is cut into an elongated rectangular pattern, the size of which depends upon the opening in the lower surface of the troffer 34. Light emitted from the light source 38 and 39 obviously comes from a complete range of angles, particularly when some light rays are reflected from the inside of the troffer or luminaire 34, as is usual to maximize the efficiency of operation. As a result, without the provisions of the various features of the lens network grid of this invention, some of this light would exit from the luminaire in the undesirable high glare range of 60° to 90°. The lens network grid which has been described concentrates this light, which otherwise would fall into the high glare range, and redistributes it into the useful range of 0° to 60°; so that maximum efficiency is obtained with light in the useful area beneath the luminaire. In a computer generated analysis of an ideal fixture of the type described above, 96% to 98% of the available light exited in the desirable range of 0° to 60°.

Figure 2:
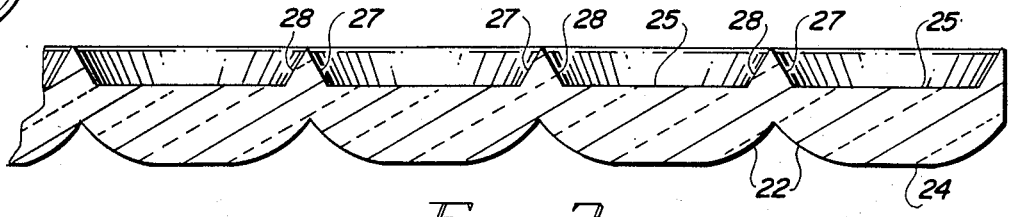
FIG. 2 is a cross-section taken along the line 2—2 of FIG. 1.

To more fully understand the manner in which the lens network grid which has been described above achieves the desired results, refence now should be made to FIGS. 6 through 11 which illustrate the refraction of incident light rays from 25° to 75° upon the upper surface of a refractive lens grid network of the type shown in FIGS. 1 through 4. Each of FIGS. 6 through 11 comprises a cross-section of a portion of the lens network taken directly through the center of a row of lenses, as illustrated in FIG. 2. Obviously, at any given time, rays of light impinging upon the upper surface 25 of each of the individual lenses come from all directions. In order to avoid confusion, however, bundles of light rays all in the same direction but at different angles are illustrated for each of the different FIGS. 6 through 11 to show the manner in which light is concentrated in the useful light range of 0° to 60° (0° being a line vertical to the surfaces 25); and showing the manner in which glare light in the range from 60° to 90° is either blocked or redirected by the lens network grid.

Figure 6:
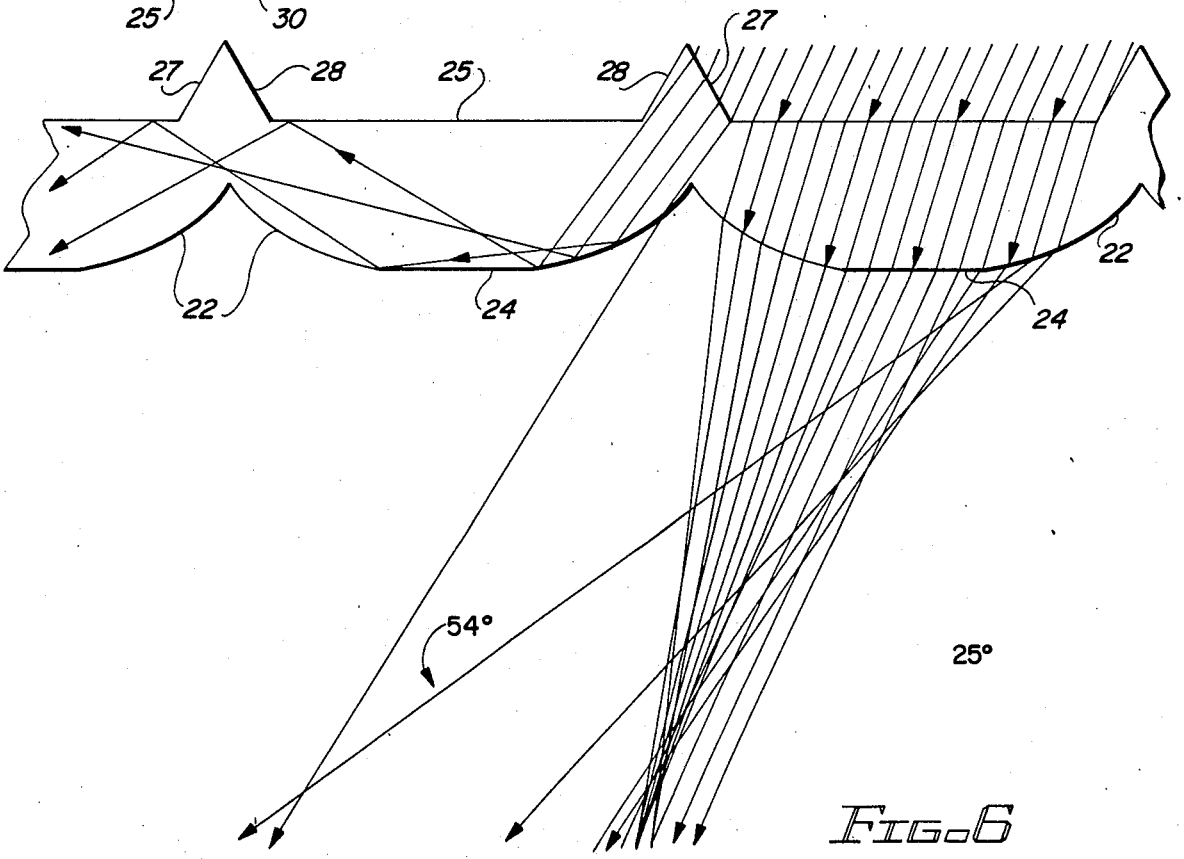
FIGS. 6 through 11 are diagrammatic cross-sectional views illustrating the refraction of incident light rays at different angles impinging upon a grid of the type illustrated in FIGS. 1 through 4.
Figure 7:
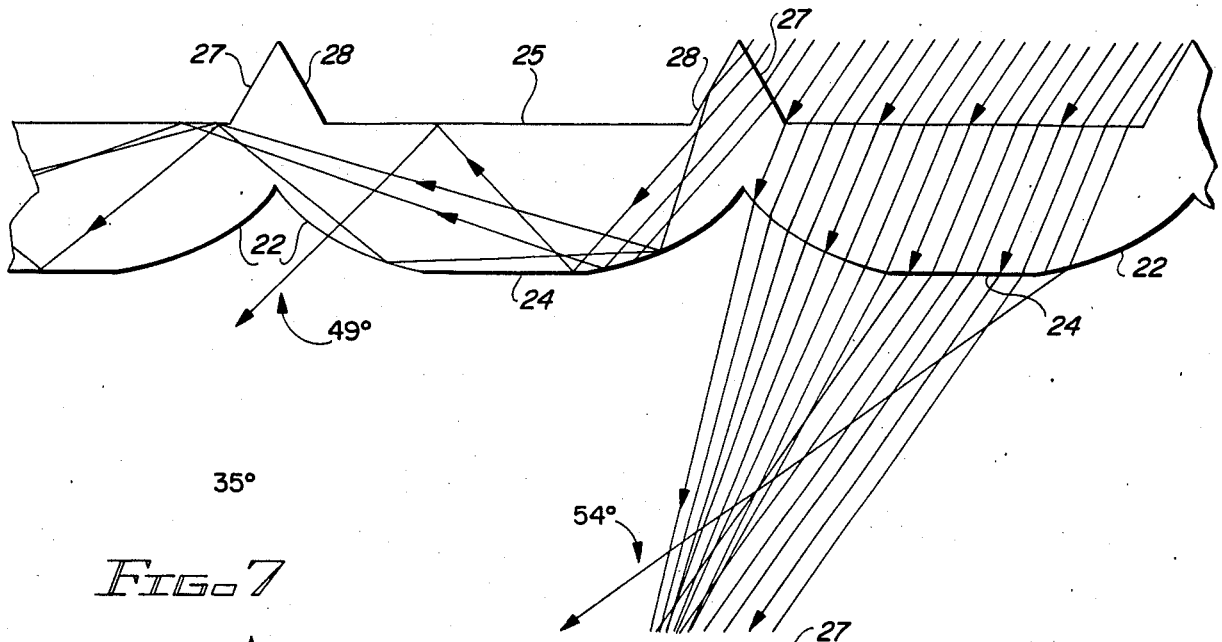
Figure 8:
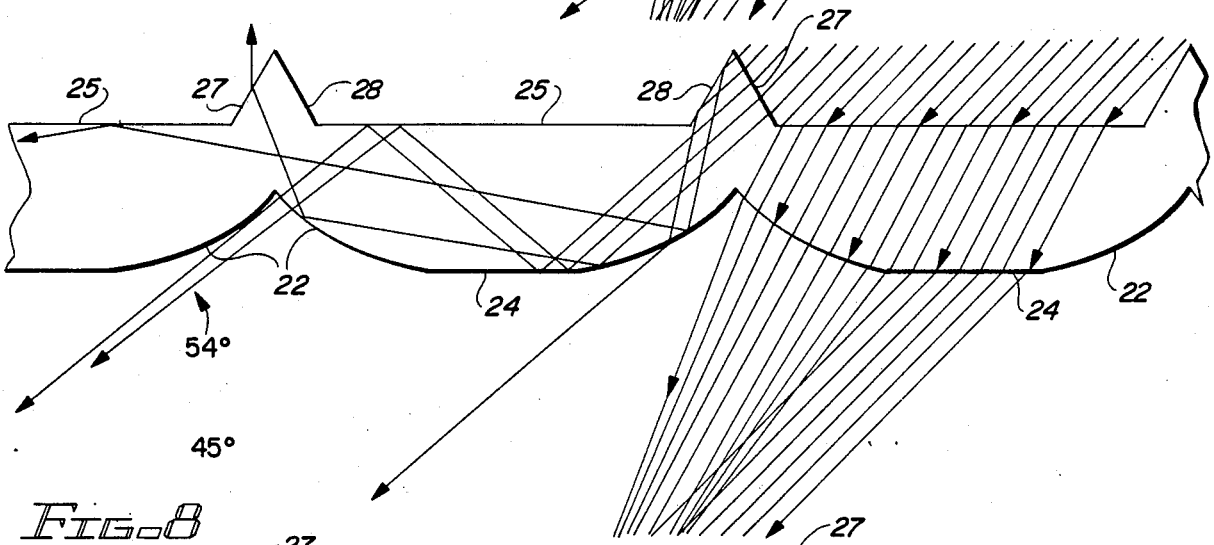
Figure 9:
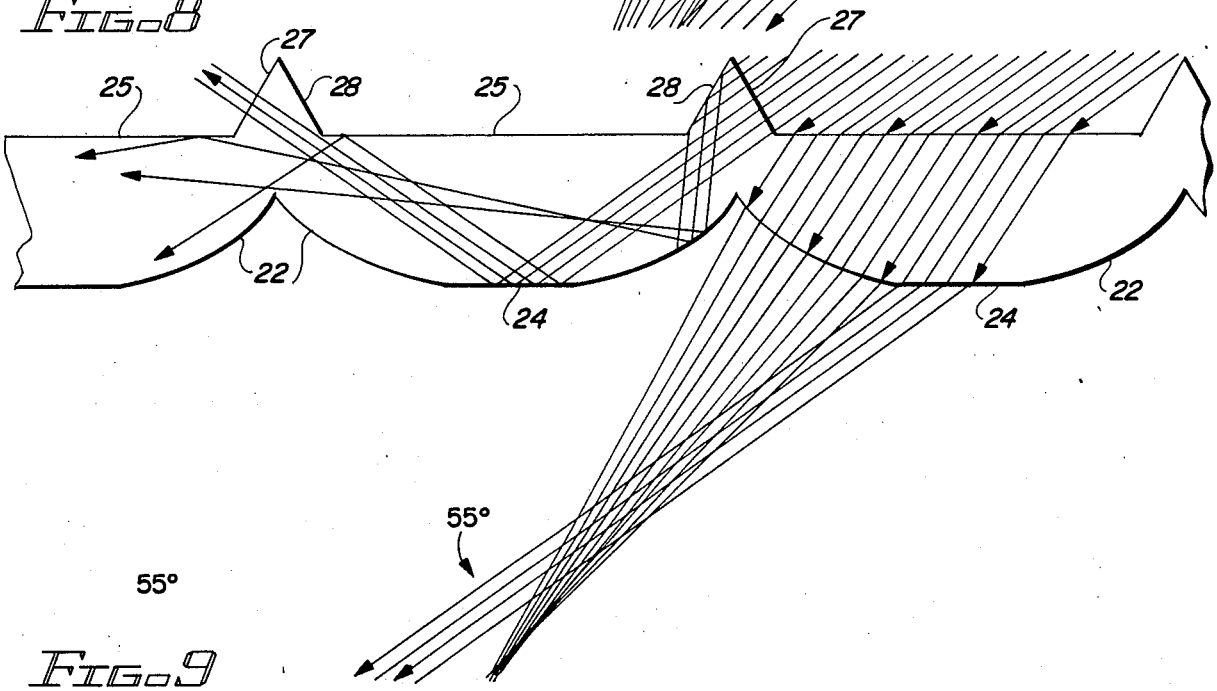

In FIG. 6, the incident light is shown impinging upon the upper surface of the lens network at 25°. Light is illustrated as coming from the upper right corner of the portion of the network grid shown in FIG. 6 and is shown impinging over the entire upper surface 25 and the adjacent surface 27 of the right-most individual lens elements. It should be understood that light at 25° impinges upon all of the lens elements, but only the light on one element is illustrated in order to avoid confusing clutter. The light rays are refracted in varying amounts depending upon where they strike the upper flat incident surface 25 of each of the lens elements. The bundle of rays are then redirected as illustrated in FIG. 6.

Some rays which strike the surface 27 undergo multiple internal reflections within adjacent lens elements; and either are redirected ultimately through different ones of the individual lenses into the useful light range of 0° to 60°, or are reflected outwardly from the upper surface of the lens network grid. As is shown in FIG. 6, the light ray emerging with the highest angle is the ray at 54°. All of the other light rays emerge from each lens in a dispersed pattern in the area from 0° to 54°.

Figure 10:
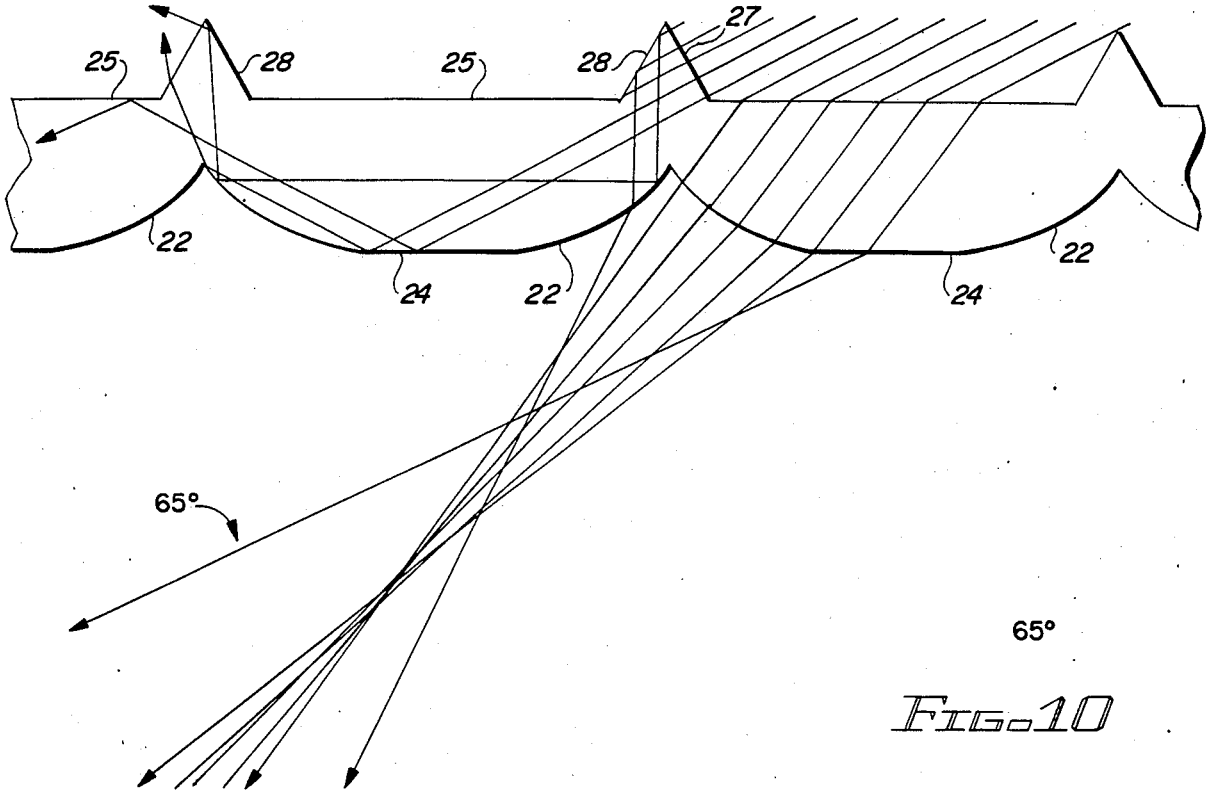
Figure 11:
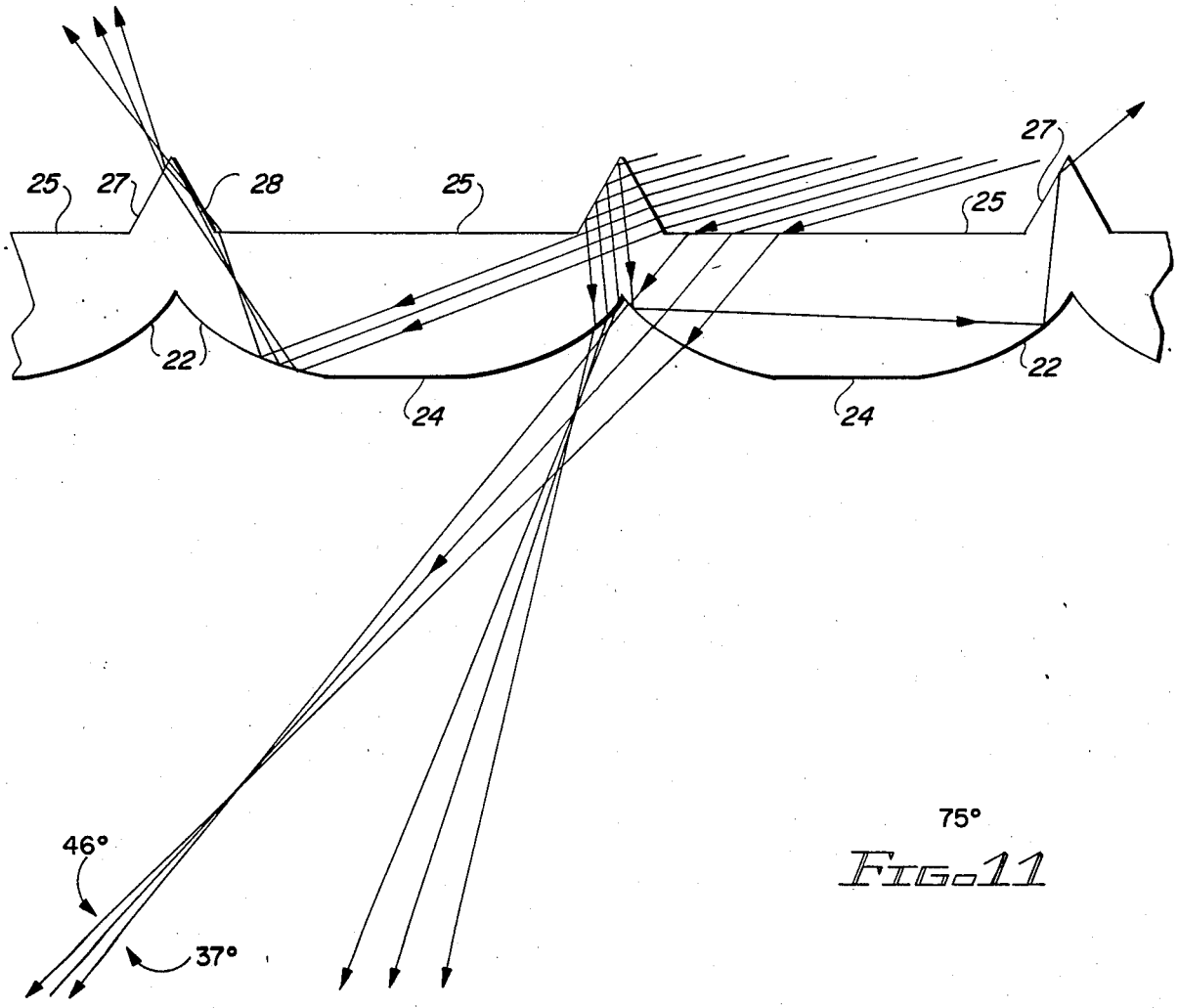

FIGS. 7, 8, 9, 10, and 11 illustrate incident light rays at increasing 10° increments, with FIG. 11 showing incident light from a source at 75° impinging upon the lens network grid. In each of these figures, the light ray at the highest angle of emergence is identified. As is apparent from an examination of FIGS. 6 through 11, it can be seen that the guard bands provided by the frusto-conical sections 27 and 28 serve two purposes. Some light rays which impinge upon these surfaces are redirected through single or multiple reflections to emerge at angles within the desired range of 0° to 60° from the lower surface of the lens network grid. Other light rays are reflected after single or multiple reflections outwardly from the top surface of the network.

With the exception of a very limited number of rays which undergo self-cancelling double refraction, since they pass through the small circular flat portion 24 of the lenses and exit at the same angle of incidence, no light rays pass through in the 60° to 90° range. The exception occurs for a very few light rays in the region from 60° to 65° so that a limited number of light rays emerge from the lens network grid at 65° as shown in FIG. 10. An examination of FIGS. 1, 2, and 3, however, shows that a very limited number of light rays exit at this angle due to the relatively small diameter of the circular flat portions 24 on the lowermost surfaces of the light emergent side of the lens network grid. In fact, the amount of light which is emitted at angles between 60° and 65° is so small as to be nearly undetectable.

The flat surfaces 24 are employed to facilitate the use of flat ejection pins in the molds used to make the lens network grid and substantially facilitate the manufacturing process. Consequently, the compromise with the small amount of light which emerges in the range between 60° and 65° from the very center of the individual lenses readily can be tolerated.

Also, as is apparent from an examination of FIGS. 6 through 11, light which impinges upon the upper or light incident surface of the lens network grid at angles within the "glare" range is redirected into the useful light range of 0° to 60° below the fixture is reflected back out through the upper surface of the fixture. Extremely good glare reduction is obtained with the lens structure which has been described.

A significant glare control is obtained particularly in the region from 70° to 80°, as contrasted with the lens of U.S. Pat. No. 3,763,369. This is a result of the increased refraction which occurs as a result of the flat top surface of each lens prism with the relatively small radius of the convex bottom surfaces. The resultant effect, as clearly illustrated in FIGS. 6 through 11, is an extremely low brightness at angles close to the horizontal (actually from 60° to 90°) and, consequently, negligible glare. Such a strong concentration of light in the useful range cannot be obtained from lens where the light incident and light emergent surfaces are close to parallel to one another as with the lens of U.S. Pat. No. 3,763,369.

Another significant advantage which is obtained by the use of the flat top surface 25 of each of the individual lens prisms is obtained during the manufacturing process. The die plate which is required to form the top surfaces 25 is flat with circular V-shaped cuts to produce the frusto-conical surfaces 27 and 28. As a consequence, the flat surfaces may be readily polished to very close tolerances with commonly available polishing equipment. In lens structures, however, where the top or light incident surfaces of each of the individual lens prisms are not flat, but rather concave, the die plate for forming this concave surface must consist of a multitude of convex surfaces. Each of these surfaces then requires individual polishing to obtain the desired finish on the lens formed by such a mold. Such polishing, however, is very likely to distort the curvature. Another advantage of using a flat top surface 25 of each of the individual lens prisms is that dirt does not accumulate at a concentrated point in the center of each lens prism as it does in the case of a concave light incident surface for each lens element. In the structure which is illustrated in the various figures of the drawing, dirt accumulation is more likely to be uniform over the entire upper surface 25 of each lens element and, as a consequence, is less noticeable after the lens has been in place over a period of time.

The lens structure which has been described above in conjunction with the various figures of the drawing is one which produces increased efficiency as measured by the recommended IES procedures. In addition, the lens network provides improved glare control and great improvement in lamp hiding power.

Various changes and modifications may be made by those skilled in the art without departing from the spirit and scope of the invention. For example, the top surfaces 25 may be made slightly convex. The dimensions given may be varied and the relative thicknesses and other proportions can be changed.

I claim:

1. A refractive lens member with improved lamp hiding characteristics for use with a luminaire having a light source including in combination:

a plurality of individual transparent lenses arranged in a network, each lens having a substantially flat light incident surface located in the same plane and each having a substantially convex section light emergent surface in all planes perpendicular to the plane of said light incident surfaces:

a transparent prism network extending above the plane of said light incident surfaces and interconnecting said lenses into a network grid, said prism network comprising upwardly-extending outwardly-diverging wall sections commencing on the outer edge of each of said light incident surfaces of said lenses and terminating above the plane of the incident surfaces of said lenses, said prism network cooperating with said lenses to prevent incident light generated by said light source from exiting through said emergent surfaces of said lenses at angles greater than a predetermined angle from a line perpendicular to said substantially flat incident surfaces of said lenses.

2. The combination according to claim 1 wherein said predetermined angle is 60°.

3. The combination according to claim 1 wherein said lenses are circular with a diameter of approximately $\frac{3}{8}''$ and said lenses are interconnected into network by said prism network in parallel offset rows of lenses.

4. The combination according to claim 3 wherein said offset rows of lenses are offset by an amount where a line through the center of each lens of one row drawn perpendicular to a line passing through the center of all of the lenses in the adjacent row intersects such latter line at a point midway between the centers of adjacent lenses in such adjacent row.

5. The combination according to claim 4 wherein each lens in said network is surrounded by six equally oriented other lenses in the network to produce a pattern of interconnected hexagonal lens groups within said network.

6. The combination according to claim 3 wherein the outermost portion of said light emergent surfaces of each of said lenses is a flat circular portion in a second plane parallel to the light incident surface and having a diameter less than the diameter of the flat circular light incident surface thereof.

7. The combination according to claim 6 wherein said outwardly diverging wall sections form an angle with the flat light incident surface of each of said lenses of substantially 125°.

8. The combination according to claim 7 wherein a third plane parallel to said first plane is established by the points where said outwardly diverging wall sections of adjacent lenses touch one another.

9. The combination according to claim 8 wherein said prism network has a substantially triangular flat surface in said third plane between each three triangularly arranged lenses of said network grid.

10. The combination according to claim 9 wherein said offset rows of lenses are offset by an amount where a line through the center of each lens of one row drawn perpendicular to a line passing through the center of all of the lenses in the adjacent row intersects such latter line at a point midway between the centers of adjacent lenses in such adjacent row.

11. The combination according to claim 10 wherein each lens in said network is surrounded by six equally oriented other lenses in the network to produce a pattern of interconnected hexagonal lens groups within said network.

12. The combination according to claim 11 wherein said network is substantially planar.

13. The combination according to claim 1 wherein said network is substantially planar.

14. The combination according to claim 1 wherein the outermost portion of said light emergent surfaces of each said lenses is a flat circular portion in a second plane parallel to the light incident surface and having a diameter less than the diameter of the flat circular light incident surface thereof.

15. The combination according to claim 1 wherein said outwardly diverging wall sections form an angle with the flat light incident surface of each of said lenses of substantially 125°.

* * * * *